US012416123B2

(12) United States Patent
Müller et al.

(10) Patent No.: US 12,416,123 B2
(45) Date of Patent: Sep. 16, 2025

(54) AUTOMATED SENSOR SWITCHING

(71) Applicant: Wirtgen GmbH, Windhagen (DE)

(72) Inventors: René Müller, Vettelschoß (DE); Manuel Rossa, Aachen (DE); Matthias Fritz, Hennef (DE); Christian Berning, Zülpich (DE)

(73) Assignee: Wirtgen GmbH (DE)

( * ) Notice: Subject to any disclaimer, the term of this patent is extended or adjusted under 35 U.S.C. 154(b) by 295 days.

(21) Appl. No.: 18/298,675

(22) Filed: Apr. 11, 2023

(65) Prior Publication Data

US 2024/0344279 A1 Oct. 17, 2024

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 19/004; E01C 23/088; E01C 23/127
See application file for complete search history.

(56) References Cited

U.S. PATENT DOCUMENTS

| | | | |
|---|---|---|---|
| 5,327,345 | A | 7/1994 | Nielsen et al. |
| 5,549,412 | A | 8/1996 | Malone |
| 5,612,864 | A | 3/1997 | Henderson |
| 6,371,566 | B1 | 4/2002 | Haehn |
| 7,144,191 | B2 | 12/2006 | Kieranen et al. |
| 7,946,788 | B2 | 5/2011 | Jurasz et al. |
| 8,308,395 | B2 | 11/2012 | Jurasz et al. |
| 8,388,263 | B2 | 3/2013 | Fritz et al. |
| 8,794,867 | B2 | 8/2014 | Snoeck et al. |
| 8,961,065 | B2 | 2/2015 | Snoeck et al. |
| 8,989,968 | B2 | 3/2015 | Fritz et al. |
| 9,039,320 | B2 | 5/2015 | Snoeck et al. |
| 9,096,977 | B2 | 8/2015 | Fritz et al. |
| 9,719,217 | B2 | 8/2017 | Fritz et al. |
| 9,896,810 | B2 | 2/2018 | Berning et al. |
| 11,193,245 | B2 | 12/2021 | Menzenbach et al. |
| 11,243,531 | B2 * | 2/2022 | O'Donnell ..... G05D 1/024 |
| 2002/0154948 | A1 | 10/2002 | Brabec et al. |
| 2008/0152428 | A1 | 6/2008 | Berning et al. |
| 2009/0292412 | A1 | 11/2009 | Han et al. |
| 2019/0025037 | A1 | 1/2019 | Dzomo et al. |
| 2021/0189667 | A1 * | 6/2021 | Fritz ..... E01C 23/088 |

OTHER PUBLICATIONS

Wirtgen Instruction Manual Level Pro (2011) (45 pages).

(Continued)

*Primary Examiner* — Janine M Kreck
(74) *Attorney, Agent, or Firm* — Lucian Wayne Beavers; Patterson Intellectual Property Law, PC

(57) ABSTRACT

A construction machine uses a controller configured to determine a cross-sectional profile of a design surface at a selected position and orientation of a milling drum of the construction machine. The controller automatically determines a preferred sensor sub-set from a plurality of possible sensor sub-sets selected from a set of available sensors. The preferred sensor sub-set must be usable to create at least a portion of the cross-sectional profile of the design surface. The controller automatically maintains or switches control of the milling depth to use the preferred sensor sub-set.

20 Claims, 6 Drawing Sheets

(56) References Cited

OTHER PUBLICATIONS

Wirtgen Instruction Manual Level Pro Plus (2014) (53 pages).
Wirtgen Instruction Manual Cold Milling Machine W 200 Fi/W 207 Fi (2019) (509 pages).
Wirtgen Cold Milling Manual (2019) (282 pages).
Wirtgen Instruction Manual Cold Milling Machine W 200 F (2019) (475 pages).
U.S. Appl. No. 17/725,640 (co-pending, not prior art).
European Search Report for corresponding patent application No. 24169140.1, dated Sep. 25, 2024, 7 pages (not prior art).

* cited by examiner

AUTOMATED SENSOR SWITCHING

BACKGROUND OF THE INVENTION

1. Field of the Invention

The present application relates to a construction machine such as a road milling machine having a working implement for working a ground surface and to methods of operation of such a construction machine.

2. Description of the Prior Art

A grade control system for a road milling machine is disclosed in U.S. Pat. No. 8,308,395. This system allows the operator of the milling machine to select the desired sensors from the available sensors and to manually direct a change of operative sensors from one sensor subset to another.

It is also known from U.S. Patent Publication No. 2002/0154948 to automatically switch between two available sensors on a construction machine when an operative one of the sensors becomes inoperable.

There is a continuing need for improved grade control systems to provide further functionality to a construction machine, and particularly to a milling machine.

SUMMARY OF THE INVENTION

In a first embodiment a method is provided of controlling a construction machine including a machine frame having a longitudinal frame axis extending between a front end and a rear end of the machine frame, a milling drum supported from the machine frame and having a milling drum rotational axis perpendicular to the longitudinal frame axis, and a controller configured to control a milling depth of the milling drum as the construction machine moves across a ground surface, the method including steps of:

(a) providing to the controller a design surface data set defining a design surface to be created in a reference system external to the construction machine;

(b) providing to the controller a priority ranking of a plurality of possible sensor sub-sets selected from a set of available sensors;

(c) performing a milling operation with the milling drum as the construction machine moves across the ground surface;

(d) determining with the controller, data representative of a cross-sectional profile of the design surface defined by an intersection of the design surface by an imaginary plane normal to the longitudinal frame axis and including the rotational axis of the milling drum at a selected position and orientation of the milling drum in the reference system external to the construction machine;

(e) determining with the controller a preferred sensor sub-set that is usable to create at least a portion of the cross-sectional profile of the design surface at the selected position and orientation of the milling drum in the reference system external to the construction machine and that has a highest priority ranking of all usable sensor sub-sets; and (f) automatically maintaining or switching control of the milling depth with the controller to use the preferred sensor sub-set.

In a second embodiment in step (d) the selected position and orientation of the milling drum in the reference system external to the construction machine is a current position and orientation of the milling drum in the reference system external to the construction machine.

In a third embodiment in step (d) the selected position and orientation of the milling drum in the reference system external to the construction machine is a predicted future position and orientation of the milling drum in the reference system external to the construction machine.

In fourth embodiment in step (d) the selected position and orientation of the milling drum in the reference system external to the construction machine is a predicted future position and orientation of the milling drum in the reference system external to the construction machine and step (f) is performed at least by a time when the milling drum reaches the predicted future position and orientation of the milling drum in the reference system external to the construction machine.

In a fifth embodiment in step (d) the selected position and orientation of the milling drum in the reference system external to the construction machine is a predicted future position and orientation of the milling drum in the reference system external to the construction machine and step (f) is performed prior to a time when the milling drum reaches the predicted future position and orientation of the milling drum in the reference system external to the construction machine.

In a sixth embodiment step (e) of the first embodiment may include: (e)(1) determining all sensor sub-sets that are usable to create the at least a portion of the cross-sectional profile of the design surface at the selected position and orientation of the milling drum in the reference system external to the construction machine; and (e)(2) selecting the usable sub-set having the highest priority ranking.

In a seventh embodiment step (e) of the first embodiment may include determining whether the sensor sub-set having the highest priority ranking is usable to create the at least a portion of the cross-sectional profile of the design surface at the selected position and orientation of the milling drum in the reference system external to the construction machine; selecting the sensor sub-set having the highest priority ranking if the sensor sub-set having the highest priority ranking is usable; and if the sensor sub-set having the highest priority ranking is not usable, then determining whether a sensor sub-set having a next highest priority ranking is usable to create the at least a portion of the cross-sectional profile of the design surface at the selected position and orientation of the milling drum in the reference system external to the construction machine.

In an eighth embodiment in step (b) of the first embodiment the set of available sensors may include at least a left side plate sensor, a right side plate sensor and a cross slope sensor and the possible sensor sub-sets may include: (1) at least the left and right side plate sensors; (2) the left side plate sensor and the cross slope sensor; and (3) the right side plate sensor and the cross slope sensor.

In a ninth embodiment as a further modification of the eighth embodiment in step (b) the priority ranking of the plurality of possible sensor sub-sets may be: first priority ranking is a currently used sub-set; second priority ranking is the left and right side plate sensors; and third priority ranking is any one of the remaining possible sensor sub-sets.

In a tenth embodiment as a further modification of the eighth embodiment in step (b) the set of available sensors may further include a left leading sensor in front of the milling drum and a right leading sensor in front of the milling drum. And the possible sensor sub-sets may further include: the left and right leading sensors; the left leading sensor and the cross slope sensor; the right leading sensor and the cross slope sensor; and the left or right leading sensor with an opposite side plate sensor.

In an eleventh embodiment as a further modification of the tenth embodiment in step (b) the priority ranking of the plurality of possible sensor sub-sets is: first priority ranking is the currently used sub-set; second priority ranking is the left and right side plate sensors; third priority ranking is the left and right leading sensors; fourth and fifth priority rankings are either of the left or right side plate sensors and an opposite leading sensor; sixth and seventh priority rankings are either of the left or right side plate sensors and the cross slope sensor; and eighth and ninth priority rankings are either of the left or right leading sensors and the cross slope sensor.

In any of the above embodiments in step (d) the data representative of the cross-sectional profile of the design surface may include data representative of the cross-sectional profile of the design surface at locations laterally outside of the milling drum.

In any of the above embodiments in step (d) the data representative of the cross-sectional profile of the design surface may include data corresponding to first and second ends of the milling drum and at least one intermediate point on the milling drum between the first and second ends.

In any of the above embodiments in step (d) the data representative of the cross-sectional profile of the design surface may include data representative of at least three points on the cross-sectional profile of the design surface.

In any of the above embodiments step (e) may include detecting a discontinuity in the cross-sectional profile of the design surface at the selected position and orientation of the milling drum in the reference system external to the construction machine.

In any of the above embodiments step (e) may include detecting a discontinuity in the cross-sectional profile of the design surface at the selected position and orientation of the milling drum in the reference system external to the construction machine, and if the discontinuity is a crown of the cross-sectional profile lying in a path of the milling drum, selecting a portion of the cross-sectional profile on one side of the discontinuity to be milled by the milling drum.

In any of the above embodiments step (e) may include detecting a discontinuity in the cross-sectional profile of the design surface at the selected position and orientation of the milling drum in the reference system external to the construction machine, and if the discontinuity is a trough of the cross-sectional profile lying in a path of the milling drum, selecting a preliminary cut to be made by the milling drum such that no part of the milling drum mills below the cross-sectional profile.

In any of the embodiments in step (e) the determining of the preferred sensor sub-set may include determining that the preferred sensor sub-set is both theoretically usable and is currently operative.

In any of the above embodiments in step (a) the design surface data set may include x, y and z coordinate data of the design surface. The design surface data set may be in any coordinate system suitable for representing geographical references.

In another embodiment a construction machine includes a machine frame having a longitudinal frame axis extending between a front end and a rear end of the machine frame. A milling drum is supported from the machine frame and has a milling drum rotational axis perpendicular to the longitudinal frame axis. A controller is configured to control a milling depth of the milling drum as the construction machine moves across a ground surface, the controller having stored in a memory a design surface data set defining a design surface to be created in a reference system external to the construction machine and a priority ranking of a plurality of possible sensor sub-sets selected from a set of available sensors, the controller being further configured to: (a) determine data representative of a cross-sectional profile of the design surface defined by an intersection of the design surface by an imaginary plane normal to the longitudinal frame axis and including the rotational axis of the milling drum at a selected position and orientation of the milling drum in the reference system external to the construction machine; (b) determine a preferred sensor sub-set that is usable to create at least a portion of the cross-sectional profile of the design surface at the selected position and orientation of the milling drum in the reference system external to the construction machine and that has a highest priority ranking of all usable sensor sub-sets; and (c) automatically maintain or switch control of the milling depth to use the preferred sensor sub-set.

Numerous objects, features and advantages of the embodiments set forth herein will be readily apparent to those skilled in the art upon reading of the following disclosure when taken in conjunction with the accompanying drawings.

DETAILED DESCRIPTION

The following disclosure describes multiple embodiments of a construction machine having a working implement for working a ground surface. In the embodiment as described with regard to FIGS. 1-14 the construction machine may be a road milling machine wherein the working implement is a milling drum.

Figure 1:
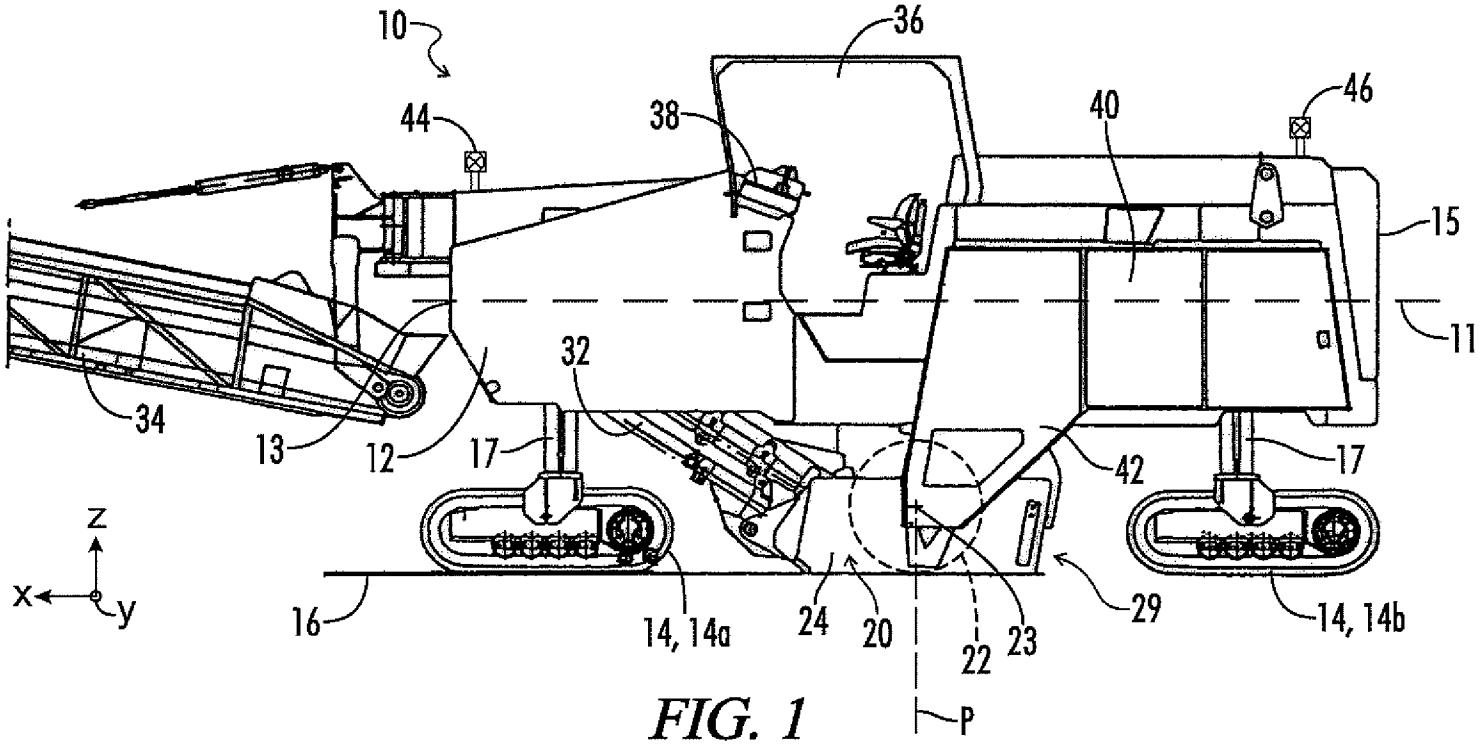
FIG. 1 is a left side elevation view of a construction machine embodied as a road milling machine incorporating the present invention.

Referring now to the drawings, and particularly to FIG. 1 a construction machine in the form of a road milling machine is shown and generally designated by the number 10. The machine 10 includes a machine frame 12. The machine frame 12 has a longitudinal frame axis 11 extending between a front end 13 and a rear end 15 of the machine frame 12. The A plurality of ground engaging units 14, shown in the form of tracks support the machine 10 from a ground surface 16. Wheeled ground engaging units may also be used. The ground engaging units 14 include two front ground engaging units 14*a* and two rear ground engaging units 14*b*. A plurality of lifting columns 17 support the machine frame 12 in a height adjustable manner from the ground engaging units 14.

A milling drum housing 20 is supported from the machine frame 12. A rotatable milling drum 22 is at least partially received by the milling drum housing 20 and is also supported from the machine frame 12. Milling drum 22 has a rotational axis 23. Thus, a height of the machine frame 12 and the milling drum 22 relative to the ground surface 16 are adjustable by adjusting an extension of the lifting columns 17. On its left and right sides, the milling drum housing 20 is closed by left and right adjustable height side plates 24 and 26 located adjacent left and right ends 28 and 30 of milling drum 22. A height adjustable scraper blade 29 may close a rear of the milling drum housing 20.

The earth working machine 10 shown in FIG. 1 is of the type generally referred to as a large front loading milling machine, which also includes first and second conveyor sections 32 and 34 for conveying milled material away from the milling drum 22. An operator's station 36 may be carried on the machine frame 12 and a control panel 38 may be located at the operator's station 36. A main engine 40, which may be in the form of a diesel internal combustion engine or any other suitable power source is located behind the operator's station 36. A direct belt drive arrangement (not shown) may connect the engine 40 to the milling drum 22 in a known manner. The direct belt drive arrangement may be located in a belt housing portion 42.

Figure 10:
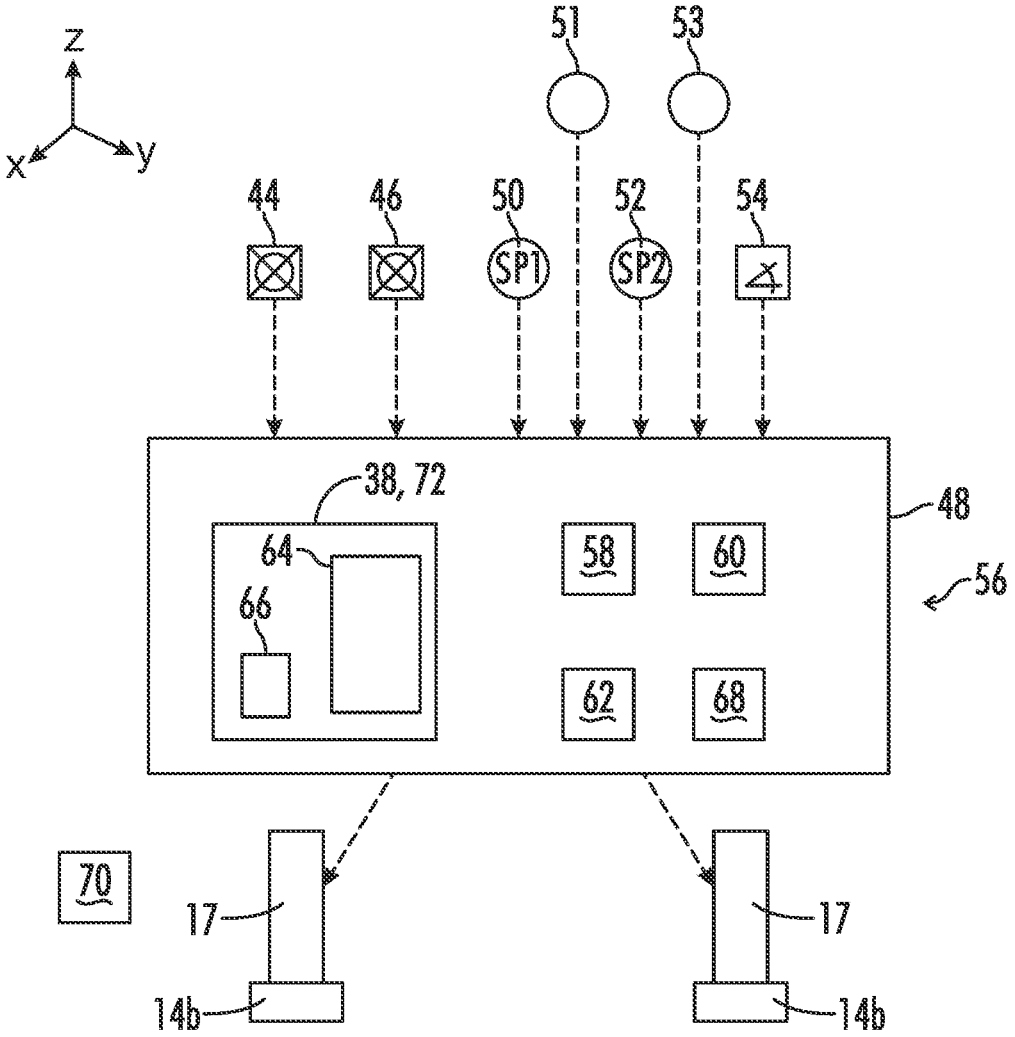
FIG. 10 is a schematic illustration of the controller with associated sensor inputs and control outputs in the embodiment of the milling machine of FIGS. 1-9.

The construction machine 10 may carry at least one position data determination component 44 and 46, supported from the machine frame 12 and operable to determine position data to define a current position of a reference point on the machine in a reference system external to the construction machine. In one embodiment the at least one position data determination component includes at least two position data determination components 44 and 46 in the form of Global Navigation Satellite System sensors, for example GPS sensors. In another embodiment the position data determination components 44 and 46 may be reflectors configured for use with a laser based Robotic Total Station. By including at least two such position data determination components the position of the locations of the two position data determination components allow the corresponding positions of all points on the machine 10 to be determined. The x, y and z components of such a reference system external to the milling machine are schematically represented in FIGS. 1 and 10. The x, y positions may represent positions in a horizontal plane and the z position may represent vertical positions relative to the horizontal plane. In FIG. 1 the x direction happens to be shown as corresponding to the forward direction of the milling machine and to the longitudinal frame axis 11 but that is purely coincidental and is in no way required.

Controller:

Position signals from the sensors 44 and 46 may be received in a controller 48 of the construction machine 10 as schematically shown in FIG. 10. The controller 48 is described here in the context of its usage with the road milling machine 10 to control a milling depth of the milling drum during a milling operation.

The controller 48 may also receive signals from height sensors 50 and 52 associated with the left and right side plates 24 and 26, respectively, which signals correspond to actual milling depths of the left and right ends 28 and 30, respectively. The height sensors 50 and 52 may for example be integral to hydraulic smart cylinders which support the side plates 24 and 26 relative to the machine frame 12. Controller 48 may also receive a signal from a gravity based slope sensor 54 indicative of a cross-slope of the machine frame 12. As is further explained below the controller 48 may send command signals to the left and right lifting columns, for example the left and right rear lifting columns 17 to adjust the actual milling depths of the left and right ends 28 and 30 of the milling drum 22.

Figure 2:
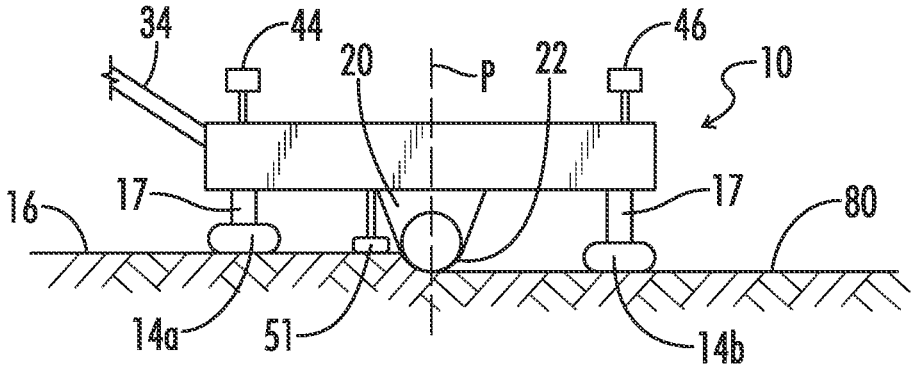
FIG. 2 is a schematic left side elevation view of the road milling machine of FIG. 1 performing a milling operation, wherein the rear tracks of the road milling machine are running in the milled track.

In a further embodiment the construction machine 10 may include a left leading sensor 51 in front of the milling drum 22 near a left end of the milling drum, and a right leading sensor 53 in front of the milling drum 22 near a right end of the milling drum. The left leading sensor 51 is schematically shown in FIG. 2. The left and right leading sensors 51 and 53 are schematically shown in FIG. 10. The left and right leading sensors 51 and 53 may be ground engaging sensors associated with a hold down mechanism in front of the milling drum 22. Examples of such leading sensors are shown in U.S. Patent Application Publication No. 2019/0025037 to Dzomo et al., the details of which are incorporated herein by reference. The left and right leading sensors 51 and 53 may for example be integrated in smart hydraulic cylinders associated with ground engaging skis located in front of the milling drum.

As schematically illustrated in FIG. 10, the construction machine 10 includes a control system 56 including the controller 48. The controller 48 may be part of the machine control system of the construction machine 10, or it may be a separate control module. The controller 48 may be associated with the control panel 38 located at the operator's station 36. The controller 48 is configured to receive input signals from the various sensors, such as the sensors 44, 46, 50, 51, 52, 53 and 54 already described. The signals transmitted from the various sensors to the controller 48 are schematically indicated in FIG. 10 by lines connecting the sensors to the controller with an arrowhead indicating the flow of the signal from the sensor to the controller 48.

Similarly, the controller 48 will generate control signals for controlling the operation of the various actuators such as the lifting columns 17 associated with rear ground engaging units 14*b*, which control signals are indicated schematically in FIG. 10 by lines connecting the controller 48 to graphic depictions of the various actuators with the arrow indicating the flow of the command signal from the controller 48 to the respective actuators. It will be understood that for control of a hydraulic cylinder type actuator the controller 48 may send an electrical signal to an electro/mechanical control valve (not shown) which controls flow of hydraulic fluid to and from the hydraulic cylinder.

Controller 48 includes or may be associated with a processor 58, a computer readable medium 60, a data base 62 and an input/output module or control panel 38 having a display 64. An input/output device 66, such as a keyboard, joystick or other user interface, is provided so that the human operator may input instructions to the controller. It is understood that the controller 48 described herein may be a single controller having all of the described functionality, or it may include multiple controllers wherein the described functionality is distributed among the multiple controllers.

Various operations, steps or algorithms as described in connection with the controller 48 can be embodied directly in hardware, in a computer program product 68 such as a software module executed by the processor 58, or in a combination of the two. The computer program product 68 can reside in RAM memory, flash memory, ROM memory, EPROM memory, EEPROM memory, registers, hard disk, a removable disk, or any other form of computer-readable medium 60 known in the art. An exemplary computer-readable medium 60 can be coupled to the processor 58 such that the processor can read information from, and write information to, the memory/storage medium. In the alternative, the medium can be integral to the processor. The processor and the medium can reside in an application specific integrated circuit (ASIC). The ASIC can reside in a user terminal. In the alternative, the processor and the medium can reside as discrete components in a user terminal.

The term "processor" as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices, e.g., a combination of a DSP and a microprocessor, a plurality of microprocessors, one or more microprocessors in conjunction with a DSP core, or any other such configuration.

Figure 11:
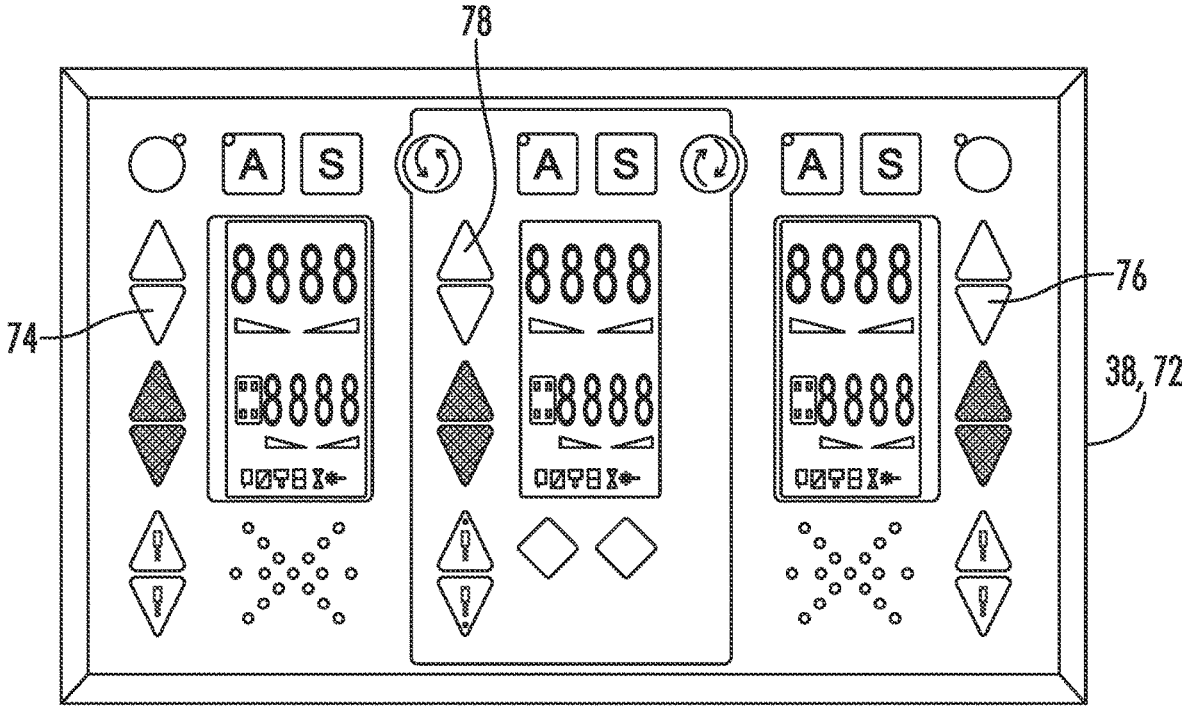
FIG. 11 is a schematic illustration of a control panel of the controller associated with the grade control system of the milling machine.

The control panel 38 may for example include a control panel as schematically shown in FIG. 11 of a grade control system 72 of the milling machine 10. The grade control system 72 may for example be a LevelPro grade control system as developed by Wirtgen GmbH, the assignee of the present application. A further description of such a grade control system 72 is found in U.S. Pat. No. 8,308,395, the details of which are incorporated herein by reference. The operator of the milling machine may control the desired milling depth at each end 28 and/or 30 of the milling drum 22 by inputting that depth, e.g., 2.0", into the grade control system 72. Alternatively, the operator can input desired milling depth at one end of the milling drum plus desired cross slope of the milling drum. FIG. 11 shows a control panel 38 by means of which a human operator may input set values for the milling depths of the ends of the milling drum and/or the cross-slope angle of the milling drum. As is further explained in U.S. Pat. No. 8,308,395 the center input device 78 can be formatted for the input of either the cross-slope or the left side or right side milling depth. The left side input device 74 can be formatted to input either the left side milling depth or the cross-slope. The right side input device 76 can be formatted to input either the right side milling depth or the cross-slope. As further described below the controller 58 may automatically generate those inputs of desired milling depth and/or cross-slope and input those values into the grade control system 72. The grade control system 72 then maintains the selected milling depth using any of several combinations of available input sensors, typically two sensors selected from the left side plate sensor 50, right side plate sensor 52 and gravity based cross slope sensor 54 or two sensor selected from the left leading sensor 51, right leading sensor 53 and gravity based cross slope sensor 54.

Building A Project Model:

When a road milling or other construction project is planned a survey may be done of the area of the ground where the milling is to take place. This may for example be the initial survey done of an area where a road or airport or the like is to be constructed. This initial survey data set may identify a series of points on the ground surface 16 which are identified by x, y and z co-ordinates in the local ground based reference system. Such surveys may be provided to a planning bureau or design office which may use the initial survey to plan a project. The "z" co-ordinate for each point is the actual elevation of that point in the local ground based reference system.

The planning bureau or design office may plan the construction project and create a project design data set which includes a design surface data set that identifies the desired final elevation of the ground surface, and which identifies the project (e.g. a pavement or other structure) to be constructed on the ground surface. One part of this design work is to create a description of the desired milled surface to be created by the road milling machine. This desired surface may be identified by a design surface data set defining a series of desired milled points in the area which are again identified by x, y and z co-ordinates in the local ground based reference system. The "z" co-ordinate for each point is the desired elevation of that point in the local ground based reference system. The databases are each typically in the form of a set of triangles, each triangle being defined by the absolute x,y,z information for the three corners defined in an external reference system independent of the milling machine. For the "actual data set" defining the existing ground surface the dimensions of the triangles are typically on the order of a few millimeters up to a few inches. For the "design surface data set" the triangles may be much larger and may be larger than the milling machine so that it is possible the milling machine will be located on a single triangle.

Alternative forms of a design surface data set may also be used. For example, instead of describing the design surface with x, y, z values the design surface may be described by defining key points of interest such as a crown line. For example, a road surface might be defined by a starting point, an axis, a gradient (which might include longitudinal inclination and/or cross slope) and a cross-sectional shape of the road profile. Such a design surface description may be transformed into x, y, z data either on or off of the construction machine.

Furthermore, discontinuities in the design surface may be extracted from x, y, z data and provided to the controller 48 as additional information so that it is not necessary to detect those discontinuities on the fly as the construction machine 10 is operating.

Milling Depth Control Techniques:

Various techniques have been developed for controlling the milling depth of a milling drum to create a design surface. One preferred technique as further described below involves the creation of a milling depth data set of x, y and milling depth data. With such a milling depth data set the milling depth is controlled to the desired value dependent upon the sensed x,y position of the milling drum. Another technique is that shown for example in U.S. Pat. No. 9,039,320 in which a desired milling drum elevation is determined in the reference system external to the construction machine, and the elevation of the milling drum is controlled to the desired elevation found in the design data set.

When using the preferred technique a milling depth data set of x, y and milling depth data may be created. The milling depth data set may be prepared with a separate processor 70 schematically shown in FIG. 10 (i.e. not the processor 58 located on the milling machine 10) and may be prepared prior to the loading of the milling depth data set on the controller 48 of the milling machine 10. The milling depth data set is not created in real time during the milling operation.

Thus, for example, the planning bureau which creates the design surface data set describing the desired milled surface, may create the milling depth data set by a comparison of the initial survey data set with the design surface data set describing the desired milled surface. Similarly, the milling depth data set may be created on or near the jobsite, by a comparison of the initial survey data set with the design surface data set describing the desired milled surface 81. It is also noted that the milling depth data set may be updated during a milling operation. For example, it may be decided to perform a desired milling operation in two cuts rather than one. Thus, if the initial milling depth is 4 cm at a particular x, y location, it might be desired to do that it two passes of about 2 cm each. A first pass may be made at a first milling depth less than 4 cm. The controller may then update the milling depth data set by subtracting the depth of the initial cut from the initial milling depth. Then on a second pass the updated milling depth data set will be used to control the cut to the final total desired milling depth.

It will be appreciated that the local ground based coordinate system in which the initial survey and the design surface data set are created may not be the same coordinate system as the Global Navigation Satellite System in which the sensors 44 and 46 operate, but the correlations of the positions in the local ground based coordinate system relative to positions in the Global Navigation Satellite System are known and the one or the other data sets may be converted as necessary for comparison to signals in the selected reference system of the sensors 44 and 46 being used.

The milling depth data set and the design surface data set may then be loaded into the memory 60 of the controller 48 on the milling machine 10. The milling depth data set and the design surface data set may be loaded onto the memory 60 of the milling machine 10 by wireless connection. Alternatively, the milling depth data set and the design surface data set may be loaded onto the memory 60 of the milling machine 10 by placing the same on a portable data storage device such as a memory stick or the like and then transferring the data from the portable data storage device to the memory 60 of the milling machine 10. This may be described as providing the milling depth data set and the design surface data set to the controller 48. As used herein "providing" a data set to the controller 48 includes in any way making the data set accessible by the controller 48, and it is not necessary that the data set be stored in a memory integral to the controller.

It is not necessary to provide the initial survey data set to the controller 48 of the milling machine 10.

In one embodiment the separate processor 70 may be associated with an online portal created as a service to owner/operators of the milling machine 10. The machine owner/operator and/or a surveyor and/or planning bureau working with the machine owner may upload their survey data set and design surface data set to the online portal. Then the separate processor 70 may create the milling depth data set and format the milling depth data set and the design surface data set for use with the milling machine 10. When the owner/operator of the milling machine 10 is ready to perform the milling operation the milling depth data set and the design surface data set may be wirelessly downloaded from the separate processor 70 of the online portal to the controller 48 of the milling machine 10.

The road milling machine 10 may then perform a ground milling operation as schematically illustrated in FIGS. 2-5. The road milling machine may be equipped with the GPS or other GNSS sensors 44 and 46 onboard the milling machine 10 that are used to determine the milling machine location as it moves across the ground surface 16. More particularly the GNSS system may determine the x,y position of each end 28 and 30 of the milling drum 22 in a reference system external to the milling machine 10, for example in the global positioning coordinates of the GPS system. Those x, y positions of the ends 28 and 30 of milling drum 22 may be correlated to the x, y positions of the milling depth data set and the design surface data set. Based upon the x, y positions of the ends 28 and 30 of milling drum 22 detected by sensors 44 and 46 the controller 48 may determine desired milling depths at each end of the milling drum and the desired cross slope as follows and may feed those input values to the grade control system 72 of the milling machine 10.

Based upon the x, y position of the left end 28 of the milling drum 22 the controller 48 may look up the desired milling depth at that location in the (x, y, milling depth) data set, and may feed that value to the left side milling depth input 74 of the grade control system 72.

Based upon the x, y position of the right end 30 of the milling drum 22 the controller 48 may look up the desired milling depth at that location in the (x, y, milling depth) database, and may feed that value to the right side milling depth input 78 of the grade control system 72.

Based upon the x, y positions of the left and right ends 28 and 30 of the milling drum 22, and optionally at least one point between the left and right ends, the controller 48 may look up the design elevation at each of those points in the design surface database and determine a design cross slope and may feed that value to the cross slope input 76 of the grade control system 72. The desired cross-slope for any given location of the milling drum 22 corresponding to any given x, y positions of the left and right ends 28 and 30 of the milling drum 22 may be determined in several ways as further described below with reference to FIGS. 6-9.

Figure 3:
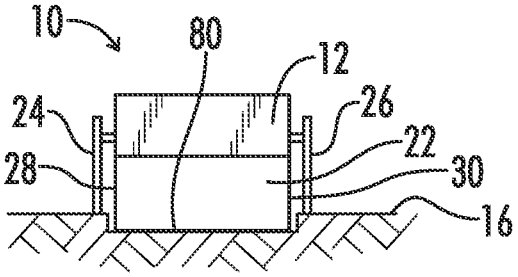
FIG. 3 is a schematic rear elevation view of the machine of FIG. 2 when performing a first pass milling operation.
Figure 4:
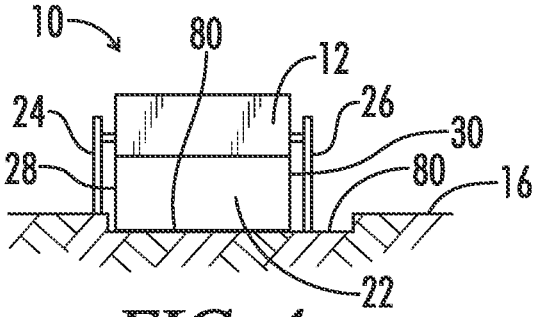
FIG. 4 is a schematic rear elevation view of the machine of FIG. 3 when performing a second pass milling operation adjacent the first pass milling operation.
Figure 5:
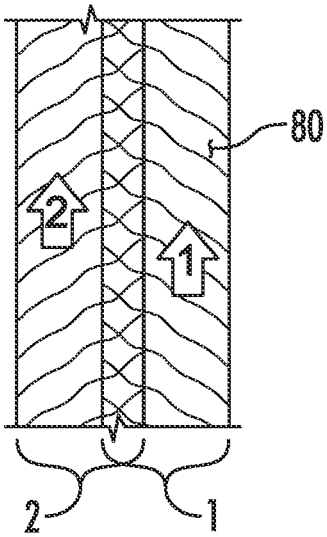
FIG. 5 is a schematic plan view of the ground surface having been milled in both a first pass and a second pass milling operation.

FIG. 5 schematically shows a plan view of both a "first pass" milling operation and an overlapping "second pass" milling operation. The "first pass" is indicated by the shaded area with a "1" in an arrow. The "second pass" is indicated by a shaded area with a "2" in an arrow. FIG. 3 is a schematic rear elevation cross-section view showing the milling machine 10 during the "first pass". FIG. 4 is a schematic rear elevation cross-section view showing the milling machine 10 during the "second pass".

On a typical "first pass" milling operation as represented in FIG. 3 the milling machine 10 may begin on the uncut actual surface 16 with both side plates 24 and 26 resting on the uncut surface 16. First the operator of the milling machine may "zero" the grade control system 72. This is accomplished by lowering the machine frame 12 and the milling drum 22 until the milling drum 22 first touches the surface 16 to be milled. This setting of the extension of the lifting columns 17 and this position of the side plates 24 and 26 is set as "zero" milling depth.

The grade control system 72 then does the actual milling depth control to that desired milling depth using any one of many possible combinations of sensor inputs. For example the grade control system 72 may use the two side plate sensors 50 and 52, or the grade control system 72 may use the cross-slope sensor 54 and one of the side plate sensors 50 or 52. Alternatively the grade control system 72 may use the two leading sensors 51 and 53, or the grade control system may use the cross-slope sensor 54 and one of the leading sensors 51 or 53. Other grade sensors such as ultrasonic or laser sensors (not shown) may also be used if available.

After such a "first pass" milling operation as seen in FIG. 3 the milling machine 10 may be operated in a "second pass" mode as seen in FIG. 4 wherein there is no control to any quantified milling depth. In a typical "second pass" milling operation the right side plate 26 is allowed to run on the previously cut surface 80 of the "first pass" and the milling depth of the right end of the milling drum is set to zero to match the previously cut surface 80. The grade control system 72 may then use the gravity based cross slope sensor 54 to control the actual cross slope to the desired cross slope.

Determination of Desired Cross-Slope and Cross-Sectional Profile of Design Surface:

For any given x, y positions of the two ends 28 and 30 of the milling drum 22 the desired cross-slope angle for the milling drum 22 can be determined by knowing the design surface elevation at those two positions, so long as the design surface is planar between those two positions. There is the possibility, however, that the design surface might have a "crown", a shoulder or other discontinuity between those two positions in which case a cross-slope determined only by comparing those two end positions might be in error. This problem can be solved by including in the cross-slope analysis at least one intermediate point between the two ends 28 and 30. This intermediate point may for example be a mid-point between the two ends. This procedure is schematically illustrated in FIGS. 6-9.

Figure 12:
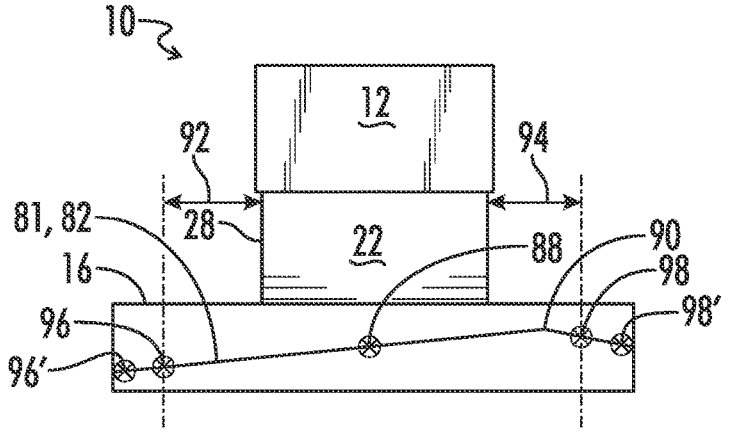
FIG. 12 is a further schematic illustration similar to FIGS. 6-9 but illustrating a technique for identifying a discontinuity in the design surface closely adjacent a planned path of the milling machine.

Furthermore, as schematically illustrated in FIG. 12, it is possible to analyze the design elevations along the line in the x, y plane for points lying laterally outside of the ends of the milling drum in order to identify the presence of non-linearities in the design surface closely adjacent a planned path of the milling machine. This allows the machine operator to perhaps modify the planned path in order to improve milling efficiency. Also, the machine operator may choose to select a different sensor to guide the milling depth control.

It will be appreciated that the desired cross-slope discussed above is the cross-slope the milling drum 22 needs to have to create the planned surface when the milling drum reaches the location in question within the reference system external to the construction machine 10. More generally, the present disclosure presents techniques for determining with the controller 48 data representative of a cross-sectional profile 82 of the design surface 81 defined by an intersection of the design surface by an imaginary plane P normal to the longitudinal frame axis 11 and including the rotational axis 23 of the milling drum 22 at a selected position and orientation of the milling drum 22 in the reference system external to the construction machine 10. In the orientation shown in FIGS. 1 and 10 with the longitudinal frame axis 11 oriented parallel to the x direction of the external reference system, the plane P is a y, z plane of the external reference system.

The desired location in the z direction and the desired cross-slope of the milling drum 22 to create the design surface is dependent upon the direction of travel of the milling machine 10. The controller 48 may determine that direction of travel from the first and second position data determination components 44, 46. Furthermore, the controller 48 may determine the data representative of the cross-sectional profile 82 of the design surface defined by an intersection of the design surface by the imaginary plane P at any selected position and orientation of the milling drum 22 in the reference system external to the construction machine 10. That selected position and orientation of the milling drum 22 may be the current position and orientation or it may be some predicted future position and orientation of the milling drum in the expected path of the milling drum 22 ahead of its current location. As will be seen in the further discussion below, this ability of the controller 48 to determine what the cross-sectional profile of the design surface under the milling drum is now and will be in the future allows the controller 48 to select the most desirable sub-set of sensors to be used for controlling the milling depth at any given time.

Figure 6:
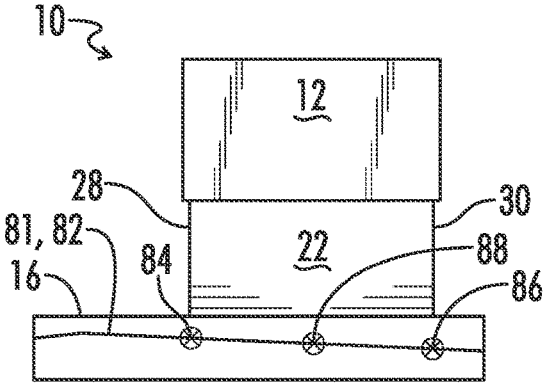
FIG. 6 is a schematic rear elevation view of the milling machine on top of a ground surface to be milled and indicating the design profile of a design surface below the ground surface. Design elevations at the current x, y positions of the left and right ends of the milling drum, and of one intermediate point of the milling drum are indicated by circled "X's". In the situation shown in FIG. 6 the design surface profile underlying the milling drum is straight and the three "X's" are aligned.

FIG. 6 schematically shows a rear elevation view of the milling machine 10 standing on the existing ground surface 16. The cross-sectional profile of the design surface defined by the intersection of the design surface by the imaginary plane P normal to the longitudinal frame axis 11 and including the rotational axis 23 of the milling drum 22 at the illustrated position and orientation of the milling drum 22 in the reference system external to the construction machine 10 is schematically represented by 82. This can also be referred to as the cross-sectional profile of the design surface 81 immediately below the milling drum 22.

A point on the cross-sectional profile 82 of the design surface 81 below the left end 28 of milling drum 22 is indicated by an "X" numbered 84. A point on the cross-sectional profile 82 of the design surface 81 below the right end 30 of milling drum 22 is indicated by an "X" numbered 86. A point on the cross-sectional profile 82 of the design surface 81 below the mid-point of milling drum 22 is indicated by an "X" numbered 88. The controller 48 is configured to compare the points 84, 86 and 88 and determine whether they lie in a straight line. If they do this indicates that there is no "crown" or other discontinuity between the end points, and the desired cross-slope is the slope of the line through the three points. Also, the vertical distance of those points below the milling drum 22 is the desired milling depth for the milling drum 22 to mill the existing ground surface to the proper level to create the desired design surface.

Figure 7:
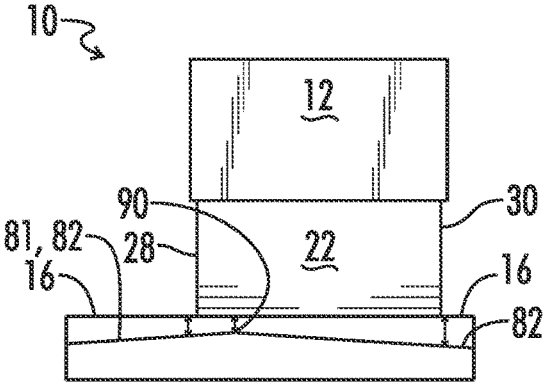
FIG. 7 is a schematic rear elevation view of the milling machine on top of a ground surface to be milled and indicating the design profile of a design surface below the ground surface. In the situation shown in FIG. 7 the design surface profile underlying the milling drum includes a crown.
Figure 8:
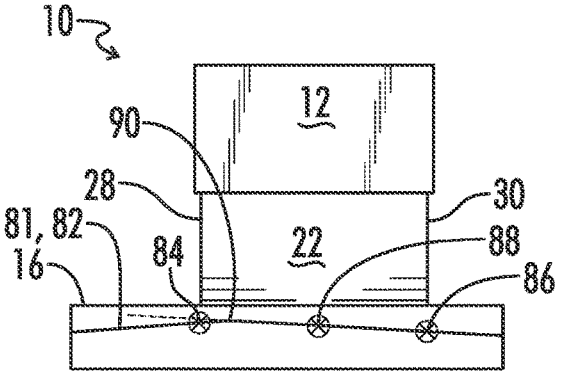
FIG. 8 is a view in the situation of FIG. 7 in which the design elevations at the current x, y positions of the left and right ends of the milling drum, and of one intermediate point of the milling drum are indicated by circled "X's". In the situation shown in FIG. 8 wherein the design surface profile underlying the milling drum includes the crown, the three "X's" are not aligned.
Figure 9:
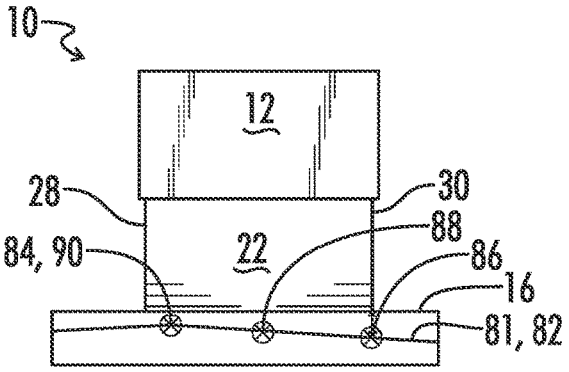
FIG. 9 is a view similar to FIG. 8, showing the location of the crown with a further circled "X" which now aligns with the "X" for the intermediate point and the "X" for the right end of the milling drum.

FIG. 7 schematically shows a rear elevation view of the milling machine standing on the ground surface, but this time standing over a portion of the cross-sectional profile 82 of the design surface 81 including a crown 90. FIG. 8 schematically illustrates the comparison by the controller 48 of these three points, which the controller 48 will determine do not lie on a straight line. Once the controller 48 determines that the three points do not lie on a straight line, the next step is to determine the location of the crown 90. This can be done by examining intermediate points inward from one of the outer points 84 and 86 until a design elevation is found that aligns with the other end point and the intermediate point 88. FIG. 9 illustrates this process wherein the left point 84 has been moved inward until it is located at the crown point 90 at which point the three points 84, 86 and 88 are found to be in a straight line. For the example seen in FIG. 9 the desired cross-slope is determined to be the slope of the line through the three points 84, 86 and 88.

It is of course also possible that the controller 48 could be configured to choose the slope to the left side of the crown 90 as the design slope. In situations like that of FIGS. 7-9 the controller may be configured to choose the desired cross-slope as the slope of the longest length underlying the milling drum 22, which in the example of FIG. 9 is the slope on the right side of the crown 90. The controller 48 may also be configured to choose one of the slopes that is contiguous with a previously milled portion, or the controller 48 may be configured such that the slope to the right or left of the crown 90 can be selected by the operator. The controller 48 may also be provided with information describing previous milling passes and may determine that the design surface to one side of the crown 90 has already been formed, in which case the controller will choose the settings necessary to mill the remaining slope on the other side of the crown 90.

FIG. 12 schematically illustrates the further alternative of examining the design elevation of points lying along the line defined by the x, y positions of the two ends of the milling drum but lying laterally outside of the length of the milling drum 22. In the illustrated embodiment the controller may be configured to examine the design milling depth elevations along a line extending between an x, y position laterally spaced a distance 92 to the left of the milling drum 22 and an x, y position laterally spaced a distance 94 to the right of the milling machine 22. The distances 92 and 94 may for example be within a range of from 0 to 3 meters, or more preferably may be within a range of 10 cm to 20 cm. The design surface elevations 96 and 98 at those x, y positions may be compared with the design surface elevation 88 at the intermediate point on the milling drum 22 in a manner similar to that described above for FIGS. 7-9. In this manner the controller 48 may identify the location of the crown or other discontinuity 90 falling within the lateral distance 94 to the right of the milling drum 22. This information may be displayed to the operator and/or utilized by the controller 48 to modify the planned path of the milling machine 10 or to select a different sensor sub-set to guide the milling depth control.

Figure 13:
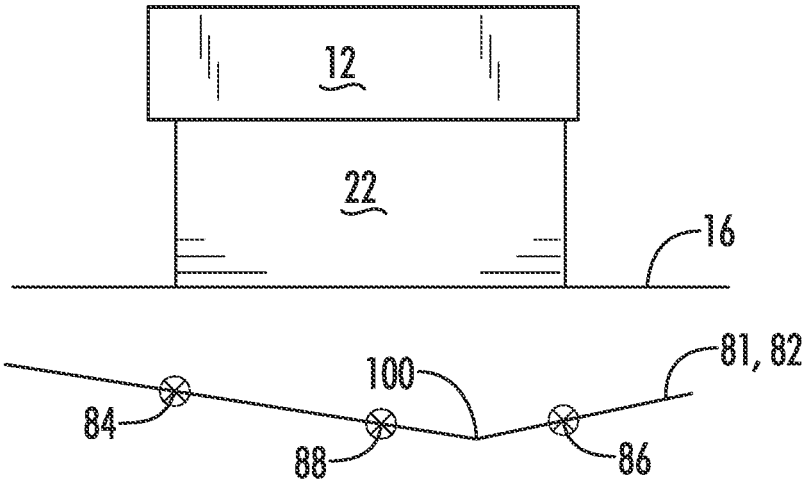
FIG. 13 is a view similar to FIG. 8, but illustrating the presence of a negative crown in the design surface.

The controller may also detect a negative crown situation as schematically shown in FIG. 13. In this situation, similar to what is described above for detecting the location of the crown 90 in FIGS. 8 and 9, the controller may move the point 86 inward until it is aligned with the pints 84 and 88 to identify the location of the negative crown 100.

Priority Ranking of Possible Sensor Sub-Sets:

It will be appreciated that when there are a plurality of choices of sensors that may be used to control the milling depth of the milling drum 22, some sub-sets may be preferred over others for various reasons.

In an embodiment, it may be preferable to maintain the use of a currently used sensor sub-set if that sensor sub-set is usable for the current control situation and if that sensor sub-set is usable for the expected control situation immediately ahead of the current location of the milling drum. The use of the currently used sub-set may be preferable because that avoids the need for changing the active control sensors and thereby avoids possible interruptions of the milling operation.

In a further embodiment, it may be preferable to control milling depth using milling depth sensors such as side plate sensors 50 and 52 or leading sensors 51 and 53, instead of using the cross slope sensor 56, because of greater accuracy of the milling depth sensors.

In yet a further embodiment, it may be preferable to control milling depth using one or both of the side plate sensors 50 and 52 rather than the leading sensors 51 and 53, because the side plate sensors are located closer to the plane P and thus more directly measure the actual milling depth. The leading sensors 51 and 53, due to their location ahead of the plane P may encounter inaccuracies due to uneven existing ground surface, or due to a longitudinal inclination of the machine frame 12 that is not exactly parallel to the ground surface.

In a further embodiment, if the milling depth control is going to use the cross slope sensor 56 it may be preferable to use the right side plate sensor 52 rather than the left side plate sensor 50, or the right leading sensor 53 rather than the left leading sensor 51, in combination with the cross slope sensor 56 because the right side plate sensor 52 or the right leading sensor 53 may be closer to the right end of the milling drum 22 and more directly viewable by the human operator of the milling machine 10. As will be understood by those skilled in the art, milling machines are typically designed such that it is the right end of the milling drum 22 which can mill the closest to obstacles and is less obscured by the typical belt and pulley drive system which drives the milling drum 22 from the left side of the milling machine 10.

Based upon such factors, and any others that may exist, the controller 48 may be provided with a priority ranking of a plurality of possible sensor sub-sets selected from the set of available sensors. This priority ranking may be saved in the memory 60 of the controller 48 and is provided by the controller 48 looking the same up in the memory 60. The operator of the milling machine 10 may also be allowed to modify the saved priority ranking via the operator interface 66.

For example, if the set of available sensors includes only the side plate sensors 50 and 52 and the cross slope sensor 56, the possible sensor sub-sets include: (1) the left and right side plate sensors 50 and 52; (2) the left side plate sensor 50 and the cross slope sensor 56; and (3) the right side plate sensor 52 and the cross slope sensor 56. With those possible sensor sub-sets the priority ranking may be:

- first priority ranking is a currently used sub-set;
- second priority ranking is the left and right side plate sensors 50 and 52;
- third priority ranking is the right side plate sensor 52 and the cross slope sensor 56; and
- fourth priority ranking is the left side plate sensor 50 and the cross slope sensor 56.

In a further example, if the set of available sensors also includes the left leading sensor 51 and the right leading sensor 53, the possible sensor sub-sets further include: (4) the left and right leading sensors 51 and 53; (5) the right leading sensor 53 and the cross slope sensor 56; (6) the left leading sensor 51 and the cross slope sensor 56; (7) the right side plate sensor 52 and the left leading sensor 51; and (8) the left side plate sensor 50 and the right leading sensor 53. With these additional possible sensor sub-sets the priority ranking of possible sensor sub-sets may be:

first priority ranking is a currently used sub-set;

second priority ranking is the left and right side plate sensors 50 and 52;

third priority ranking is the left and right leading sensors 51 and 53;

fourth priority ranking is the right side plate sensor 52 and the left leading sensor 51;

fifth priority ranking is the left side plate sensor 50 and the right leading sensor 53;

sixth priority ranking third priority ranking is the right side plate sensor 52 and the cross slope sensor 56;

seventh priority ranking is the left side plate sensor 50 and the cross slope sensor 56;

eighth priority ranking is the right leading sensor 53 and the cross slope sensor 56; and ninth priority ranking is the left leading sensor 51 and the cross slope sensor 56.

It will be appreciated that the above examples are only examples, and the operator of the milling machine or the person setting up the controller 48 may select any desired priority ranking to be provided to the controller.

Determination of Usable Sub-Sets:

It will be appreciated that depending upon various factors, including the cross-sectional profile 82 of the design surface 81 and whether that profile includes a discontinuity such as a crown 90 or negative crown 100, some sensor sub-sets may be usable to create the desired milled surface corresponding to the design surface and some sub-sets may not be usable.

For example, consider a situation as shown in FIGS. 3, 4 and 6, where the cross-sectional profile 82 to be cut is a straight line from one end 28 of the milling drum 22 to the other end 30. Assuming an available set of sensors including left side plate sensor 50, right side plate sensor 52, and cross slope sensor 54, then any two of those sensors may be usable to cut the profile 82 between points 84 and 86.

In another example, considering the situation of a crown 90 shown in FIGS. 7-9, it may be desirable to create the part of the cross-sectional profile 82 between the point 86 underlying the right end 30 of the milling drum 22 and the crown point 90. Assuming an available set of sensors including left side plate sensor 50, right side plate sensor 52, and cross slope sensor 54, the only usable combination may be the right side plate sensor 52 and the cross slope sensor 54, because the available milling depth data for the left side plate sensor 50 cannot be used to mill the plane between 86 and 90.

Figure 14:
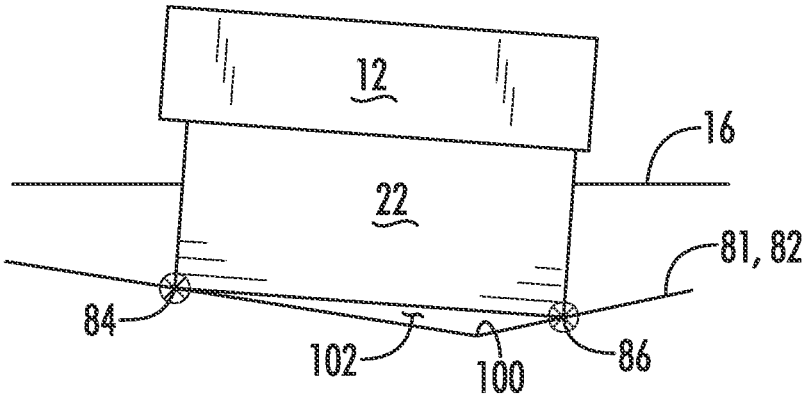
FIG. 14 shows the same design surface profile of FIG. 13 including a negative crown, with the milling machine milling a preliminary cut with the two ends of the milling drum touching the profile such that no part of the milling drum mills below the design cross-sectional profile.

In yet another example, considering the situation of a trough or negative crown 100 as shown in FIGS. 13-14, it may be desirable to make a preliminary cut as seen in FIG. 14 such that no part of the milling drum 22 mills below the cross-sectional profile 82. For example, as seen in FIG. 13, the left and right side plate sensors 50 and 52 may be used to make a preliminary cut with the left and right ends 28 and 30 of the milling drum 22 cutting to the depth of points 84 and 86. This will leave the uncut area 102 to be cut in later passes. Thus, for the cut shown in FIG. 14, the only usable combination may be the left and right side plate sensors 50 and 52.

Another example of a situation where a sensor could not be used to perform a desired milling cut would be where one of the side plate sensors was located outside the area of the design surface data set so that no data is available for the desired milling depth at the location of that side plate.

It is also possible the controller 48 could determine that no sensor sub-set is usable to make a desired milling cut. For example, both side plates might be located outside of the area of the design surface data set. It this situation the controller 48 may provide a warning or alert to the operator of the milling machine.

There are other situations where a sensor might not be usable. A side plate sensor may be running on already milled surface. The ground beneath one of the milling depth sensors may not usable for reference: a side plate sensor may be running on a shoulder that is irregular of blocked by debris; a leading sensor may not be usable due to debris in front of the milling drum. The machine might detect inconsistent sensor readings and automatically decide to not use certain sensors or the operator might decide to not use certain sensors because he realizes the conditions before the machine does. Any of this information that is detectible by the milling machine using appropriate sensors or is otherwise made available to the controller may be used by the controller in automatically determining a preferred sensor sub-set that is usable to create at least a portion of the cross-sectional profile of the design surface.

Methods of Control:

In an embodiment a method of controlling the construction machine 10 may include steps of:

(a) providing to the controller 48 a design surface data set defining a design surface to be created in a reference system (x,y,z) external to the construction machine;

(b) providing to the controller 48 a priority ranking of a plurality of possible sensor sub-sets selected from a set of available sensors;

(c) performing a milling operation with the milling drum 22 as the construction machine moves across the ground surface 16;

(d) determining with the controller 48, data representative of a cross-sectional profile 82 of the design surface 81 defined by an intersection of the design surface by an imaginary plane P normal to the longitudinal frame axis 11 and including the rotational axis 23 of the milling drum 22 at a selected position and orientation of the milling drum 22 in the reference system external to the construction machine 10;

(e) determining with the controller 48 a preferred sensor sub-set that is usable to create at least a portion of the cross-sectional profile 82 of the design surface 81 at the selected position and orientation of the milling drum 22 in the reference system external to the construction machine and that has a highest priority ranking of all usable sensor sub-sets; and (f) automatically maintaining or switching control of the milling depth with the controller 48 to use the preferred sensor sub-set.

With regard to the above step (a) of providing to the controller 48 a design surface data set defining a design surface to be created in a reference system (x,y,z) external to the construction machine, it will be appreciated that the design surface data set may be provided directly as has been discussed above, or it may be provided indirectly by providing other data from which the design surface data is derived. For example, the milling machine could be provided with an actual surface data set defining the existing surface, and a milling depth data set, and then the data for the design surface could be derived by subtracting the milling depth from the actual surface elevation.

It will be understood that the switching of control of the milling depth with the controller 48 may be done in a manner like that disclosed in U.S. Pat. No. 8,308,395 to Jurasz et al., the details of which are incorporated herein by reference. With such a system the controller 48 may switch over from control based upon a first selected sub-set of the plurality of available sensors to control based upon the preferred sensor sub-set during the milling operation without interruption of the milling operation and without any erratic alteration of the control signals being sent to the lifting columns 17.

In an embodiment in step (d) the selected position and orientation of the milling drum 22 in the reference system external to the construction machine 10 may be a current position and orientation of the milling drum 22 in the reference system external to the construction machine.

In another embodiment in step (d) the selected position and orientation of the milling drum 22 in the reference system external to the construction machine 10 may be a predicted future position and orientation of the milling drum 22 in the reference system external to the construction machine.

In such an embodiment using a predicted future position and orientation of the milling drum 22, step (f) may be performed at least by a time when the milling drum reaches the predicted future position and orientation of the milling drum in the reference system external to the construction machine.

In another embodiment using a predicted future position and orientation of the milling drum 22, step (f) may be performed prior to a time when the milling drum reaches the predicted future position and orientation of the milling drum in the reference system external to the construction machine.

It will be appreciated that step (e) may be performed in multiple ways. In one embodiment step (e) may further comprise:

(e)(1) determining all sensor sub-sets that are usable to create the at least a portion of the cross-sectional profile 82 of the design surface 81 at the selected position and orientation of the milling drum 22 in the reference system external to the construction machine 10; and (e)(2) selecting the usable sub-set having the highest priority ranking.

In another embodiment step (e) may further comprise:

determining whether the sensor sub-set having the highest priority ranking is usable to create the at least a portion of the cross-sectional profile 82 of the design surface 81 at the selected position and orientation of the milling drum 22 in the reference system external to the construction machine;

selecting the sensor sub-set having the highest priority ranking if the sensor sub-set having the highest priority ranking is usable; and if the sensor sub-set having the highest priority ranking is not usable, then determining whether a sensor sub-set having a next highest priority ranking is usable to create the at least a portion of the cross-sectional profile of the design surface at the selected position and orientation of the milling drum in the reference system external to the construction machine.

It will be appreciated that in situations like that illustrated in FIG. 12, the data representative of the cross-sectional profile 82 of the design surface 81 used in step (d) may include data representative of the cross-sectional profile 82 at locations such as 96 and 98 laterally outside of the milling drum 22. In an embodiment the data representative of the cross-sectional profile 82 of the design surface used in step (d) may include two points such as 96, 96' or 98, 98' laterally outside of the milling drum 22 to each side of the milling drum 22. The use of multiple points to each lateral side of the milling drum 22 aids in the identification of discontinuities lying outside the length of the milling drum 22.

As seen in FIGS. 6-9, the data representative of the cross-sectional profile 82 of the design surface used in step (d) may include data at points 84 and 86 corresponding to the first and second ends 28 and 30 of the milling drum 22, and at least one intermediate point on the milling drum 22 between the first and second ends, which intermediate point is directly above point 88.

The data representative of the cross-sectional profile 82 of the design surface used in step (d) may be describe as including data representative of at least three points 84, 86, 88 on the cross-sectional profile 82 of the design surface.

As seen in FIGS. 7-9 and 13-14, step (e) may include detecting a discontinuity in the cross-sectional profile 82 of the design surface at the selected position and orientation of the milling drum 22 in the reference system external to the construction machine. That discontinuity may be a crown 90 as seen in FIGS. 7-9, or a negative crown or trough 100 as seen in FIGS. 13-14, or any other discontinuity from a straight line. Another type of discontinuity could be a step formed in the ground surface by a prior milling pass either parallel to the current pass or transverse to the current pass.

If the discontinuity is a crown 90 of the cross-sectional profile 82 lying in a path of the milling drum 22, the method may include selecting a portion of the cross-sectional profile 82 on one side of the discontinuity 90 to be milled by the milling drum 22.

If the discontinuity is a trough 100 of the cross-sectional profile 82 lying in a path of the milling drum 22, the method may include selecting a preliminary cut to be made by the milling drum 22 as seen in FIG. 14 such that no part of the milling drum 22 mills below the cross-sectional profile 82.

It will be appreciated that another factor to be considered in the ultimate selection of the sub-set of sensors to be used at any time includes determining that the preferred sensor sub-set is both theoretically usable and is also currently operative. If a given sensor is not currently operative due to equipment failure or environmental obstacles or the like, then the selection process moves to the next most desirable sub-set of available sensors which is usable. An example of an environmental obstacle to the operability of a given sensor would be a side plate sensor that cannot be used because the side plate is running on an irregular surface such as a soft shoulder of the road.

As previously noted, the priority rankings may list any currently used sub-set of sensors as a highest priority in order to avoid an unnecessary change of sensors. Optionally the controller may look to the cross-sectional profile of the design surface in the path ahead of a current location of the milling drum and determine that there will be a future change required to a sensor sub-set that is higher on the priority ranking than the currently used sub-set. In that situation, because a change of sensors is going to be required anyway, the controller may go ahead and make the change from the currently used sub-set to that preferred sub-set that will be required in the future.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A method of controlling a construction machine including a machine frame having a longitudinal frame axis extending between a front end and a rear end of the machine frame, a milling drum supported from the machine frame and having a milling drum rotational axis perpendicular to the longitudinal frame axis, and a controller configured to control a milling depth of the milling drum as the construction machine moves across a ground surface, the method comprising:

(a) providing to the controller a design surface data set defining a design surface to be created in a reference system external to the construction machine;

(b) providing to the controller a priority ranking of a plurality of possible sensor sub-sets selected from a set of available sensors;

(c) performing a milling operation with the milling drum as the construction machine moves across the ground surface;

(d) determining with the controller, data representative of a cross-sectional profile of the design surface defined by an intersection of the design surface by an imaginary plane normal to the longitudinal frame axis and including the rotational axis of the milling drum at a selected position and orientation of the milling drum in the reference system external to the construction machine;

(e) determining with the controller a preferred sensor sub-set that is usable to create at least a portion of the cross-sectional profile of the design surface at the selected position and orientation of the milling drum in the reference system external to the construction machine and that has a highest priority ranking of all usable sensor sub-sets; and (f) automatically maintaining or switching control of the milling depth with the controller to use the preferred sensor sub-set.

2. The method of claim 1, wherein:

in step (d) the selected position and orientation of the milling drum in the reference system external to the construction machine is a current position and orientation of the milling drum in the reference system external to the construction machine.

3. The method of claim 1, wherein:

in step (d) the selected position and orientation of the milling drum in the reference system external to the construction machine is a predicted future position and orientation of the milling drum in the reference system external to the construction machine.

4. The method of claim 3, wherein:

step (f) is performed at least by a time when the milling drum reaches the predicted future position and orientation of the milling drum in the reference system external to the construction machine.

5. The method of claim 3, wherein:

step (f) is performed prior to a time when the milling drum reaches the predicted future position and orientation of the milling drum in the reference system external to the construction machine.

6. The method of claim 1, wherein step (e) further comprises:

(e)(1) determining all sensor sub-sets that are usable to create the at least a portion of the cross-sectional profile of the design surface at the selected position and orientation of the milling drum in the reference system external to the construction machine; and (e)(2) selecting the usable sub-set having the highest priority ranking.

7. The method of claim 1, wherein step (e) further comprises:

determining whether the sensor sub-set having the highest priority ranking is usable to create the at least a portion of the cross-sectional profile of the design surface at the selected position and orientation of the milling drum in the reference system external to the construction machine;

selecting the sensor sub-set having the highest priority ranking if the sensor sub-set having the highest priority ranking is usable; and if the sensor sub-set having the highest priority ranking is not usable, then determining whether a sensor sub-set having a next highest priority ranking is usable to create the at least a portion of the cross-sectional profile of the design surface at the selected position and orientation of the milling drum in the reference system external to the construction machine.

8. The method of claim 1, wherein:

in step (b) the set of available sensors includes at least:

a left side plate sensor;

a right side plate sensor; and a cross slope sensor; and the possible sensor sub-sets include at least:

the left and right side plate sensors;

the left side plate sensor and the cross slope sensor; and the right side plate sensor and the cross slope sensor.

9. The method of claim 8, wherein:

in step (b) the priority ranking of the plurality of possible sensor sub-sets is:

first priority ranking is a currently used sub-set;

second priority ranking is the left and right side plate sensors; and third priority ranking is any one of the remaining possible sensor sub-sets.

10. The method of claim 8, wherein:

in step (b) the set of available sensors further includes:

a left leading sensor in front of the milling drum; and a right leading sensor in front of the milling drum; and the possible sensor sub-sets further include:

the left and right leading sensors;

the left leading sensor and the cross slope sensor; and the right leading sensor and the cross slope sensor.

11. The method of claim 10, wherein:

in step (b) the priority ranking of the plurality of possible sensor sub-sets is:

first priority ranking is a currently used sub-set;

second priority ranking is the left and right side plate sensors;

third priority ranking is the left and right leading sensors;

fourth and fifth priority rankings are one of the side plate sensors and the opposite side leading sensor;

sixth and seventh priority rankings are either of the left or right side plate sensors and the cross slope sensor; and eighth and ninth priority rankings are either of the left or right leading sensors and the cross slope sensor.

12. The method of claim 1, wherein:

in step (d) the data representative of the cross-sectional profile of the design surface includes data representative of the cross-sectional profile of the design surface at locations laterally outside of the milling drum.

13. The method of claim 1, wherein:

in step (d) the data representative of the cross-sectional profile of the design surface includes data corresponding to first and second ends of the milling drum and at least one intermediate point on the milling drum between the first and second ends.

14. The method of claim 1, wherein:

in step (d) the data representative of the cross-sectional profile of the design surface includes data representative of at least three points on the cross-sectional profile of the design surface.

15. The method of claim 1, wherein step (e) includes:

detecting a discontinuity in the cross-sectional profile of the design surface at the selected position and orientation of the milling drum in the reference system external to the construction machine.

16. The method of claim 15, wherein step (e) further includes:

if the discontinuity is a crown of the cross-sectional profile lying in a path of the milling drum, selecting a portion of the cross-sectional profile on one side of the discontinuity to be milled by the milling drum.

17. The method of claim 15, wherein step (e) further includes:

if the discontinuity is a trough of the cross-sectional profile lying in a path of the milling drum, selecting a preliminary cut to be made by the milling drum such that no part of the milling drum mills below the cross-sectional profile.

18. The method of claim 1, wherein:

in step (e) the determining of the preferred sensor sub-set includes determining that the preferred sensor sub-set is both theoretically usable and is currently operative.

19. The method of claim 1, wherein:

in step (a) the design surface data set includes x, y and z coordinate data of the design surface.

20. A construction machine, comprising:

a machine frame having a longitudinal frame axis extending between a front end and a rear end of the machine frame;

a milling drum supported from the machine frame and having a milling drum rotational axis perpendicular to the longitudinal frame axis;

a controller configured to control a milling depth of the milling drum as the construction machine moves across a ground surface, the controller having stored in a memory a design surface data set defining a design surface to be created in a reference system external to the construction machine and a priority ranking of a plurality of possible sensor sub-sets selected from a set of available sensors, the controller being further configured to:

(a) determine data representative of a cross-sectional profile of the design surface defined by an intersection of the design surface by an imaginary plane normal to the longitudinal frame axis and including the rotational axis of the milling drum at a selected position and orientation of the milling drum in the reference system external to the construction machine;

(b) determine a preferred sensor sub-set that is usable to create at least a portion of the cross-sectional profile of the design surface at the selected position and orientation of the milling drum in the reference system external to the construction machine and that has a highest priority ranking of all usable sensor sub-sets; and (c) automatically maintain or switch control of the milling depth to use the preferred sensor sub-set.

* * * * *